US007761291B2

(12) United States Patent
Renevey et al.

(10) Patent No.: US 7,761,291 B2
(45) Date of Patent: Jul. 20, 2010

(54) METHOD FOR PROCESSING AUDIO-SIGNALS

(75) Inventors: Philippe Renevey, Lausanne (CH); Philippe Vuadens, Blonay (CH); Rolf Vetter, Monnaz (CH); Stephan Dasen, Cortaillod (CH)

(73) Assignee: Bernafon AG, Berne (CH)

( * ) Notice: Subject to any disclaimer, the term of this patent is extended or adjusted under 35 U.S.C. 154(b) by 879 days.

(21) Appl. No.: 10/568,610

(22) PCT Filed: Aug. 19, 2004

(86) PCT No.: PCT/EP2004/009283

§ 371 (c)(1),
(2), (4) Date: Dec. 22, 2006

(87) PCT Pub. No.: WO2005/020633

PCT Pub. Date: Mar. 3, 2005

(65) Prior Publication Data

US 2007/0100605 A1 May 3, 2007

(30) Foreign Application Priority Data

Aug. 21, 2003 (EP) ..... 03388055

(51) Int. Cl.
*G10L 21/02* (2006.01)

(52) U.S. Cl. ..... 704/225; 704/226; 381/23.1; 381/94.3

(58) Field of Classification Search ..... 704/225, 704/226; 381/23.1, 94.3
See application file for complete search history.

(56) References Cited

U.S. PATENT DOCUMENTS 5,479,522 A 12/1995 Lindemann et al.
5,511,128 A 4/1996 Lindemann
5,757,932 A 5/1998 Lindemann et al.
5,966,639 A 10/1999 Goldberg et al.
5,991,419 A 11/1999 Brander (Continued)

FOREIGN PATENT DOCUMENTS

EP 1 017 253 A2 7/2000
EP 1 326 478 A2 7/2003
EP 1 509 065 A 2/2005

OTHER PUBLICATIONS

Wittkop T et al., Acta Acustica, Editions De Physique. Les Ulis Cedex, FR, vol. 83, No. 4, 1997, pp. 684-699.

(Continued)

*Primary Examiner*—Daniel D Abebe
(74) *Attorney, Agent, or Firm*—Birch, Stewart, Kolasch & Birch, LLP

(57) ABSTRACT

The invention regards a method for processing audio-signals whereby audio signals are captured at two spaced apart locations and subject to a transformation in the perceptual domain (Bar or Mel), whereupon: a) a (blind or supervised) source separation process is performed to give a first estimate of the wanted signal parts and the noise parts of the microphone signals and b) a coherence based separation process is performed to give a second estimate of the wanted signal parts and the noise parts of the microphone signals, and where further a sound field diffuseness detection is performed on the at least two signals, whereby further the sound field diffuseness detections is used to mix the output from the blind source separation and the coherence based separation process in order to achieve the best possible signal. The transfer functions calculated from the source separation are used to reconstruct a virtual stereophonic sound field in restore the spatial information about the source position in the enhanced signals.

3 Claims, 3 Drawing Sheets

U.S. PATENT DOCUMENTS

| | | | | |
|---|---|---|---|---|
| 6,002,776 | A | 12/1999 | Bhadkamkar et al. | |
| 6,018,317 | A | 1/2000 | Dogan et al. | |
| 6,104,822 | A | 8/2000 | Melanson et al. | |
| 6,130,949 | A * | 10/2000 | Aoki et al. | 381/94.3 |
| 6,148,087 | A | 11/2000 | Martin | |
| 6,154,552 | A | 11/2000 | Koroljow et al. | |
| 6,327,370 | B1 | 12/2001 | Killion et al. | |
| 6,343,268 | B1 | 1/2002 | Balan et al. | |
| 6,424,960 | B1 * | 7/2002 | Lee et al. | 706/20 |
| 6,430,528 | B1 | 8/2002 | Rickard et al. | |
| 7,099,821 | B2 * | 8/2006 | Visser et al. | 704/226 |
| 7,383,178 | B2 * | 6/2008 | Visser et al. | 704/227 |
| 2003/0014248 | A1 | 1/2003 | Vetter | |
| 2008/0300652 | A1 * | 12/2008 | Lim et al. | 607/56 |

OTHER PUBLICATIONS

J. B. Allen et al., J Acoust. Soc. Am., vol. 62, No. 4, Oct. 1977, pp. 912-915.
Lucas Parra et al., IEEE Transactions Speech and Audio Processing, vol. XX, No. Y, 1999, pp. 1-9.
R. Le Bouquin et al., IEEE Proceedings- I, vol. 139, No. 3, Jun. 1992, pp. 276-280.
G. Clifford Carter, IEEE Transactions on Audio and Electroacoustics, vol. AU-21, No. 4, Aug. 1973, pp. 337-344.
Steven F. Boll, IEEE Trans. Acoust., Speech, Signal Processing, vol. ASSP-27, No. 2, Apr. 1979, pp. 113-120.
Thomas Wittkop, Two-Channel noise reduction algorithms motivated by models of binaural interaction, geb. am 9. Sep. 1968 in Hamburg.
Yariv Ephraim et al., IEEE Transaction on Speech and Audio Processing, vol. 3, No. 4 Jul. 1995, pp. 251-266.
Jorn Anemuller, Across-Frequency Processing in Convolutive Blind Source Separation, geboren am Mai 21, 1971 in Lippstadt.
Electronics and Communications in Japan, vol. 67-A, No. 12, 1984 pp. 19-28.
S. Haykin, Adaptive filter theory, Prentice Hall, New Jersey, 1996 pp. 18-21, 32-33, 246-253, 256-257-259, 520-529.
Wittkop, T et al., Speech Communication, vol. 39, pp. 111-138 (2003).
Wittkop T et al., Acta Acustica, Editions De Physique. Les Ulis Cedex, FR, vol. 83, No. 4, 1997, pp. 684-699.
J. B. Allen et al., J. Acoust. Soc. Am., vol. 62, No. 4, Oct. 1977, pp. 912-915.
Lucas Parra et al., IEEE Transactions Speech and Audio Processing, vol. XX, No. Y, 1999, pp. 1-9.
R. Le Bouquin et al., IEEE Proceedings- I, vol. 139, No. 3, Jun. 1992, pp. 276-280.
D. H. Brandwood, Cross-Coupled Cancellation System for Improving Cross-Polarisation Discrimination, pp. 41-45 (1978).
G. Clifford Carter, IEEE Transactions on Audio and Electroacoustics, vol. AU-21, No. 4, Aug. 1973, pp. 337-344.
Steven F. Boll, IEEE Trans. Acoust., Speech, Signal Processing, vol. ASSP-27, No. 2, Apr. 1979, pp. 113-120.
Bootstrapping Adaptive Cross Pol Cancelers for Satellite Communications, pp. 4F.5.1-4F.535(1982).
Thomas Wittkop, Two-Channel noise reduction algorithms motivated by models of binaural interaction, geb. am 9. Sep. 1968 in Hamburg.
Yariv Ephraim et al., IEEE Transaction on Speech and Audio Processing, vol. 3, No. 4 Jul. 1995, pp. 251-266.
Volker Hohmann et al., Binaural Noise Reduction for Hearing Aids pp. IV-4000-IV4003 (2002).
Jom Anemuller, Across-Frequency Processing in Convolutive Blind Source Separation, geboren am 21. Mai 1971 in Lippstadt.
Electronics and Communications in Japan, vol. 67-A, No. 12, 1984 pp. 19-28.
S. Haykin. Adaptive filter theory. Prentice Hall, New Jersey, 1996 pp. 18-21, 32-33, 246-253, 256-257-259, 520-529.

* cited by examiner

METHOD FOR PROCESSING AUDIO-SIGNALS

AREA OF THE INVENTION

The invention is related to the area of speech enhancement of audio signals, and more specifically to a method for processing audio signal in order to enhance speech components of the signal whenever they are present. Such methods are particularly applicable to hearing aids, where they allow the hearing impaired person to better communicate with other people.

BACKGROUND OF THE INVENTION

The problem of extracting a signal of interest from noisy observations is well known by acoustics engineers. Especially, users of portable speech processing systems often encounter the problem of interfering noise reducing the quality and intelligibility of speech. To reduce these harmful noise contributions, several single channel speech enhancement algorithms have been developed [1-4]. Nonetheless, even though single-channel algorithms are able to improve signal quality, recent studies have reported that they are still unable to improve speech intelligibility [5]. In contrast, multiple-microphone noise reduction schemes have been shown repeatedly to increase speech intelligibility and quality [6,7].

Multiple microphone speech enhancement algorithms can be roughly classified into quasi-stationary spatial filtering and time-variant envelope filtering [8]. Quasi-stationary spatial filtering exploits the spatial configuration of the sound sources to reduce noise by spatial filter. The filter characteristics do not change with the dynamics of speech but with the slower changes in the spatial configuration of the sound sources. They achieve almost artefact-free speech enhancement in simple, low reverberating environments and computer simulations. Typical examples are adaptive noise cancelling, positive and differential beam-forming [30] and blind source separation [28,29]. The most promising algorithms of this class proposed hitherto are based on blind source separation (BSS). BSS is the sole technique, which aims to estimate an exact model of the acoustic environment and to possibly invert it. It includes the model for de-mixing of a number of acoustic sources from an equal number of spatially diverse recordings. Additionally, multi-path propagation, though reverberation is also included in BSS models. The basic problem of BSS consists in recovering hidden source signals using only its linear mixtures and nothing else. Assume $d_s$ statistically independent sources $s(t)=[s_1(t), \ldots, s_{s_s}(t)]^T$. The sources are convolved and mixed in a linear medium leading to $d_x$ sensor signals $x(t)=[x_1(t), \ldots, x_{d_x}(t)]^T$ that may include additional noise:

$$x(t) = \sum_{\tau=0}^{P} G(\tau)s(t-\tau) + n(t). \tag{1}$$

The aim of source separation is to identify the multiple channel transfer characteristics $G(\tau)$, to possibly invert it and to obtain estimates of the hidden sources given by:

$$u(t) = \sum_{\tau=0}^{Q} W(\tau)x(t-\tau) \tag{2}$$

where $W(\tau)$ is the estimated inverse multiple channel transfer characteristics of $G(\tau)$. Numerous algorithms have been proposed for the estimation of the inverse model $W(\tau)$. They are mainly based on the exploitation of the assumption on the statistical independence of the hidden source signal. The statistical independence can be exploited in different ways and additional constraints can be introduced, such as for example intrinsic correlations or non-stationnarity of source signals and/or noise. As a result a large number of BSS algorithms under various implementation forms (e.g. time domain, frequency domain and time-frequency domain) have been proposed recently for multiple-channel speech enhancement (see for example [28,29]).

Dogan and Stems [9] use cumulant based source separation to enhance the signal of interest in binaural hearing aids. Rosca et al. [10] apply blind source separation for de-mixing delayed and convoluted sources from the signals of a microphone array. A post-processing is proposed to improve the enhancement. Jourjine et al. [11] use the statistical distribution of the signals (estimated using histograms) to separate speech and noise. Balan et al. [2] propose an autoregressive (AR) modelling to separate sources from a degenerated mixture. Several approaches use the spatial information given by a plurality of microphone using beamformers. Koroljow and Gibian [12] use first and second order beamformer to adapt the directivity of the hearing aids to the noise conditions.

Bhadkamkar and Ngo [3] combine a negative beamformer to extract the speech source and a post-processing to remove the reverberation and echoes. Lindemann [13] uses a beamformer to extract the energy from the speech source and an omni-directional microphone to obtain the whole energy from the speech and noise sources. The ratio between these two energies allows to enhance the speech signal by a spectral weighting. Feng et al. [14] reconstructs the enhanced signal using delayed versions of the signals of a binaural hearing aid system.

BSS techniques have been shown to achieve almost artefact-free speech enhancement in simple, low reverberating environments, laboratory studies and computer simulations but perform poorly for recordings in reverberant environment or/and with diffuse noise. One could speculate that in reverberant environments the number of model parameters becomes too large to be identified accurately in noisy, non-stationary conditions.

In contrast, envelope filtering (e.g. Wiener, DCT-Bark, coherence and directional filtering) do not yield such failures since they use a simple statistical description of the acoustical environment or the binaural interaction in the human auditory system [8]. Such algorithms process the signal in an appropriate dual domain. The envelope of the target signal or equivalently a short time weighting index (short-time signal-to-noise ratio (SNR), coherence) is estimated in several frequency bands. The target is assumed to be of frontal incidence and the enhanced signal is obtained by modulating the spectral envelope of the noisy signal by the estimated short time weighting index. The adaptation of the weighting index has a temporal resolution of about the syllable rate. Dual channel approaches based on the statistical description of the sources using the coherence function have been presented [1,15-17]. Further improvements have been obtained by merging spatial coherence of noisy sound fields, masking properties of the human auditory system and subspace approaches [19].

Multi-channel speech enhancement algorithms based on envelope filtering are particularly appropriate for complex acoustic environments, namely diffuse noise and highly reverberating. Nevertheless, they are unable to provide lossless or artefact-free enhancement. Globally, they reduce noise contributions in the time-frequency domains without any speech contributions. In contrast, in time-frequency domains with speech contributions, the noise cannot be reduced and distortions can be introduced. This is mainly the reason why envelope filtering might help reducing the listening effort in noisy environments but intelligibility improvement is generally leaking [20].

The above considerations point out that performance of multiple channel speech enhancement algorithms depend essentially on the complexity of the acoustical context. A given algorithm is appropriated for a specific acoustic environment and in order to cope with changing properties of the acoustic environment composite algorithms have been proposed more recently.

The approach proposed by Melanson and Lindemann in [21] consists in a manual switching between different algorithms to enhance speech under various conditions. A manual switching between several combinations of filtering and dynamic compression has also been proposed by Lindemann et al. [22].

More advanced techniques using an automatic switching according to different noise conditions have been proposed by Killion et al. in [23]. The input of the hearing aid is switched automatically between omnidirectional and directional microphone.

A strategy selective algorithm has been described by Wittkop [24]. This algorithm uses an envelope filtering based on a generalized Wiener approach and an envelope filtering invoking directional inter-aural level and phase differences. A coherence measure is used to identify the acoustical situations and gradually switch off the directional filtering with increasing complexity. It is pointed out that this algorithm helps reducing the listening effort in noisy environments but that intelligibility improvement is still lacking.

Therefore, it is the aim of the present invention to provide a composite method including source separation and coherence based envelope filtering. Source separation and coherence based envelope filtering are achieved in the time Bark domain, i.e. in specific frequency bands. Source separation is performed in bands where coherent sound fields of the signal of interest or of a predominant noise source are detected. Coherence based envelope filtering acts in bands where the sound fields are diffuse and/or where the complexity of the acoustic environment is too large. Source separation and coherence based envelope filtering may act in parallel and are activated in a smooth way through a coherence measure in the Bark bands.

It is further an issue of the present invention to provide a real binaural enhancement of the observed sound field by using the multiple channel transfer characteristics identified by source separation. Indeed, commonly speech enhancement algorithms achieve mainly a monaural speech enhancement, which implies that users of such devices loose the ability to localize sources. A promising solution, which could achieve real binaural speech enhancement, consists of a device with one or two microphones in each ear and an RF-link in-between. The benefit for the user would be enormous. Notably it has been reported that binaural hearing increases the loudness and signal-to-noise ratio of the perceived sound, it improves intelligibility and quality of speech and allows the localization of sources, which is of prime importance in situations of danger. Lindemann and Melanson [25] propose a system with wireless transmission between the hearing aids and a processing unit wearied at the belt of the user. Brander [7] similarly proposes a direct communication between the two ear devices. Goldberg et al. [26] combine the transmission and the enhancement. Finally optical transmission via glasses has been proposed by Martin [27]. Nevertheless in none of these approaches a virtual reconstruction of the binaural sound filed has been proposed. The approach proposed herein, namely exploitation of the multiple channel transfer characteristics identified by source separation to reconstruct the real sound field and attenuat noise contribution considerably improve the security and the comfort of the listener.

[1] J. B. Allen, D. A. Berkley, and J. Blauert. Multimicrophone signal processing technique to remove room reverberation from speech signals. Journal of Acoustical Society of America, 62(4):912-915, 1977.

[2] Radu Balan, Alexander Jourjine, and Justinian Rosca. Estimator of independent sources from degenerate mixtures. U.S. Pat. No. 6,343,268 B1, January 2002.

[3] Neal Ashok Bhadkamkar and John-Thomas Calderon Ngo. Directional acoustic signal processor and method therefor. U.S. Pat. No. 6,002,776, December 1999.

[4] Y. Bar-Ness, J. Carlin, and M. Steinberg. Bootstrapping adaptive cross-pol canceller for satellite communication. In Proc. IEEE Int. Conf. Communication, pages 4F5.1-4F5.5, 1982.

[5] S. F. Boll. Suppression of acoustic noise in speech using spectral subtraction. IEEE Trans. on Acoustics, Speech and Signal Processing, 27:113-120, April 1979.

[6] D. Bradwood. Cross-coupled cancellation systems for improving cross-polarisation discrimination. In Proc. IEEE Int. Conf. Antennas Propagation, volume 1, pages 41-45, 1978.

[7] Richard Brander. Bilateral signal processing prothesis. U.S. Pat. No. 5,991,419, November 1999.

[9] Mithat Can Dogan and Stephen Deane Steams. Cochannel signal processing system U.S. Pat. No. 6,018,317, January 2000.

[10] Justianian Rosca, Christian Darken, Thomas Petsche, and Inga Holube. Blind source separation for hearing aids. European Patent Office Patent 99,310,611.1, December 1999.

[11] Alexander Jourjine, Scott T. Rickard, and Ozgur Yilmaz. Method and apparatus for demixing of degenerate mixtures. U.S. Pat. No. 6,430,528 B1, August 2002.

[12] Walter S. Koroljow and Gary L. Gibian. Hybrid adaptive beamformer. U.S. Pat. No. 6,154,552, November 2000.

[13] Eric Lindemann. Dynamic intensity beamforming system for noise reduction in a binaural hearing aid. U.S. Pat. No. 5,511,128, April 1996.

[14] Albert S. Feng, Charissa R. Lansing, Chen Liu, William O'Brien, and Bruce C. Wheeler. Binaural signal processing system and method. U.S. Pat. No. 6,222,927 B1, April 2001.

[15] Y. Kaneda and T. Tohyama. Noise suppression signal processing using 2-point received signals. Electronics and Communications, 67a(12):19-28, 1984.

[16] B. Le Bourquin and G. Faucon. Using the coherence function for noise reduction. IEE Proceedings, 139(3):484-487, 1997.

[17] G. C. Carter, C. H: Knapp, and A. H. Nuttall. Estimation of the magnitude square coherence function via overlapped fast Fourier transform processing. IEEE Trans. on Audio and Acoustics, 21(4):337-344, 1973.

[18] Y. Ephrahim and H. L. Van Trees. A signal subspace approach for speech enhancement IEEE Trans. on Speech and Audio Proc., 3:251-266, 1995.

[19] R. Vetter. Method and system for enhancing speech in a noisy environment. U.S. Patent US 2003/0014248 A1 January 2003.

[20] V. Hohmann, J. Nix, G. Grimm and T. Wittkopp. Binaural noise reduction for hearing aids. In ICASSP 2002, Orlando, USA, 2002.

[21] John L. Melanson and Eric Lindemann. Digital signal processing hearing aid. U.S. Pat. No. 6,104,822, August 2000.

[22] Eric Lindemann, John Melanson, and Nikolai Bisgaard. Digital hearing aid system. U.S. Pat. No. 5,757,932, May 1998.

[23] Mead Killion, Fred Waldhauer, Johannes Wittkowski, Richard Goode, and John Allen. Hearing aid having plural microphones and a microphone switching system. U.S. Pat. No. 6,327,370 B1, December 2001.

[24] Thomas Wittkop. Two-channel noise reduction algorithms motivated by models of binaural interaction. PhD thesis, Fachbereich Physik der Universitat Oldenburg, 2000.

[25] Eric Lindemann and John L. Melanson. Binaural hearing aid. U.S. Pat. No. 5,479,522, December 1995.

[26] Jack Goldberg, Mead C. Killion, and Jame R. Hendershot. System and method for enhancing speech intelligibility utilizing wireless communication. U.S. Pat. No. 5,966,639, October 1999.

[27] Raimund Martin. Hearing aid having two hearing apparatuses with optical signal transmission therebetween. U.S. Pat. No. 6,148,087, November 2000.

[28] J. Anemüller. Across-frequency processing in convolutive blind source separation. PhD thesis, Farbereich Physik der Universität Oldenburg, 2000.

[29] Lucas Parra and Clay Spence. Convolutive blind separation of non-stationary sources. IEEE Trans. on Speech and Audio Processing, 8(3):320-327, 2000.

[30] S. Haykin. Adaptive filter theory. Prentice Hall, New Jersey 1996.

SUMMARY OF THE INVENTION

The invention comprises a method for processing audio-signals whereby audio signals are captured at two spaced apart locations and subject to a transformation in the perceptual domain (Bark or Mel decomposition), whereupon the enhancement of the speech signal is based on the combination of parametric (model based) and non-parametric (statistical) speech enhancement approaches:

a. a source separation process is performed to give a first estimate of the wanted signal parts and the noise parts of the microphone signals and b. a coherence based envelope filtering is performed to give a second estimate of the wanted signal parts of the microphone signals, and where further a sound field diffuseness detection is performed on the at least two signals, whereby further the sound field diffuseness detections is used to mix the output from the first and the second source separation process in order to achieve the best possible signal. The transfer functions estimated by the source separation algorithms are used to reconstruct a virtual stereophonic sound field (spatial localisation of the different sound sources).

When the speech and noise sources are in the direct sound field (direct path between sound sources and microphones is dominant, reverberation is low), the transmission transfer function from each source in each source ear system can be estimated and used to separate speech and noise signals by the use of source separation. These transfer functions are estimated using source separation algorithms. The learning of the coefficients of the transfer functions can be either supervised (when only the noise source is active) or blind (when speech and noise sources are active simultaneously). The learning rate in each frequency band can be dependant on the signals characteristics. The signal obtained with this approach is the first estimated of the clean speech signal.

When the noise signal is in the reverberant sound field (contributions from reverberations is comparable to those of the direct path), source separation approaches fails due to the complexity of the transfer functions to be evaluated. A statistical based envelope filtering can be used to extract speech from noise. The short-time coherence function calculated in the transform domain (Bark or Mel) allows estimating a probability of presence of speech in each Bark or Mel frequency band. Applying it to the noisy speech signal allows to extract the bands where speech is dominant and attenuate those where noise is dominant. The signal obtained with this approach is the second estimate of the clean speech signal.

These two estimates of the clean speech signal are then mixed to optimise the performance of the enhancement. The mixing is performed independently in each frequency band, depending on the sound field characteristic of each frequency band. The respective weight for each approach and for each frequency band is calculated from the coherence function.

During the combination of the signals calculated from the two approaches, the transfer functions estimated by source separation are used to reconstruct a virtual stereophonic sound field and to recover the spatial information from the different sources.

In a further embodiment of the invention the sound field diffuseness detection is based on the value of a short-time coherence function where the coherence function is expressed as:

$$\Gamma_{x1x2}(\omega) = \frac{\phi_{x1x2}(\omega)}{\sqrt{\phi_{x1x1}(\omega)\cdot\phi_{x2x2}(\omega)}}$$

This function varies between zero and one, according to the amount of "coherent" signal. When the speech signal dominates the frequency band, the coherence is close to one and when there is no speech in the frequency band, the coherence is close to zero. Once the diffuseness of the sound field is known, the results of the source separation and of the coherence based approach can be combined optimally to enhance the speech signals. The combination can be the use of one of the approach when the noise source is totally in the direct sound field or totally in the diffuse sound field, or a combination of the results when some of the frequency bands are in the direct sound field and other are in the diffuse sound field.

DESCRIPTION OF A PREFERRED EMBODIMENT

The aim of a hearing aid system is to improve the intelligibility of speech for hearing-impaired persons. Therefore it is important to take into account the specificity of the speech signal. Psycho-acoustical studies have shown that the human perception of frequency is not linear with frequency but the sensitivity to frequency changes decreases as the frequency of the sound increases. This property of the human hearing system has been widely used in speech enhancement and speech recognition system to improve the performances of such systems. The use of critical band modeling (Bark or Mel frequency scale) allows to improve the statistical estimation of the speech and noise characteristics and, thus, to improve the quality of the speech enhancement.

When the speech and noise sources are in the direct sound field (low reverberating acoustical environment), the transmission transfer function of each source in each ear system can be estimated and used to separate the speech and noise signals. The mixing system is presented in FIG. 2.

Figure 1:
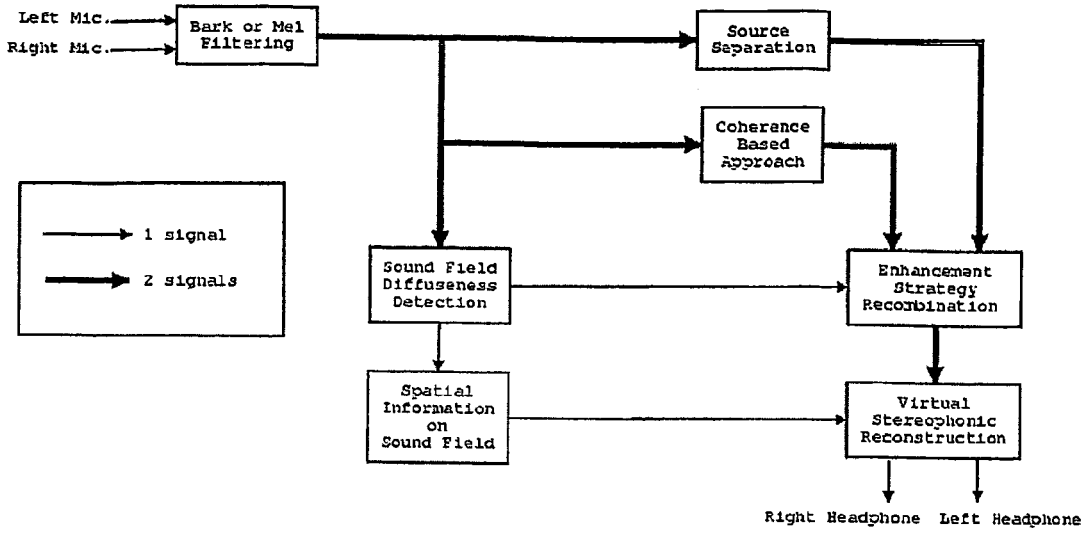
FIG. 1 is a block diagram of the proposed approach.
Figure 2:
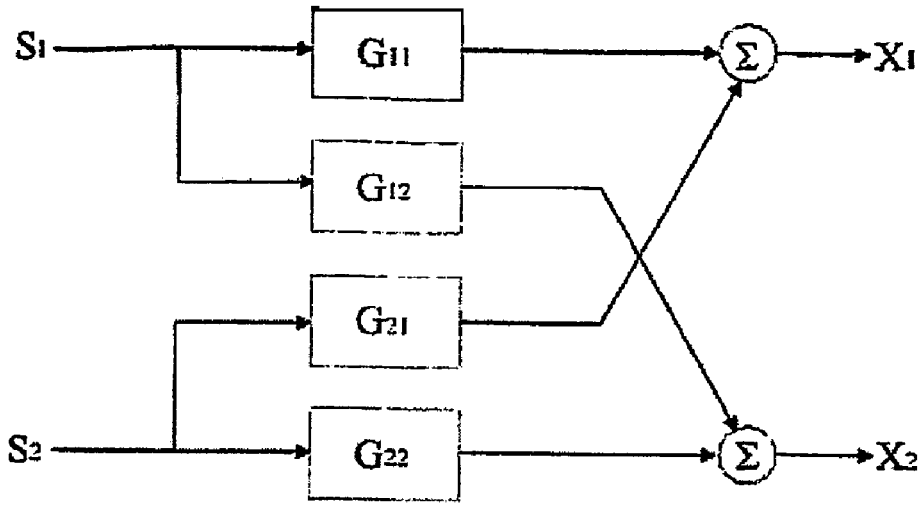
FIG. 2 is a complete mixing model for speech and noise sources.
Figure 3:
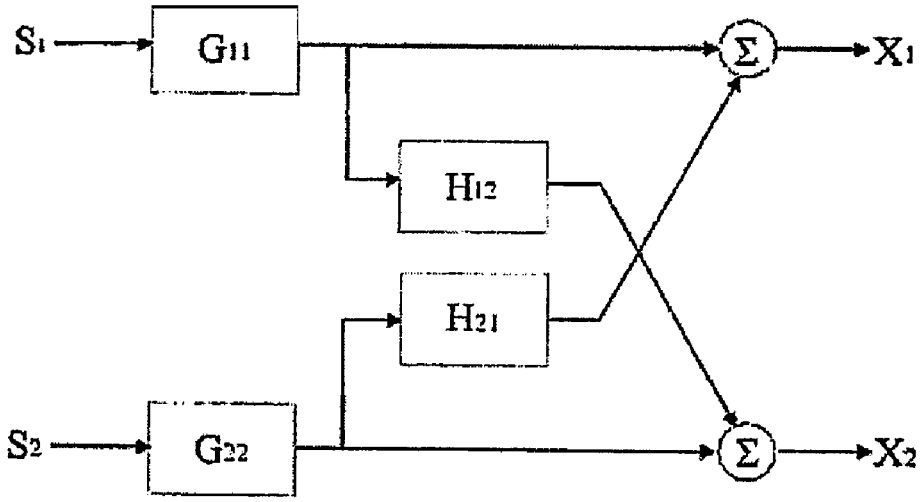
FIG. 3 is a modified mixing model.
Figure 4:
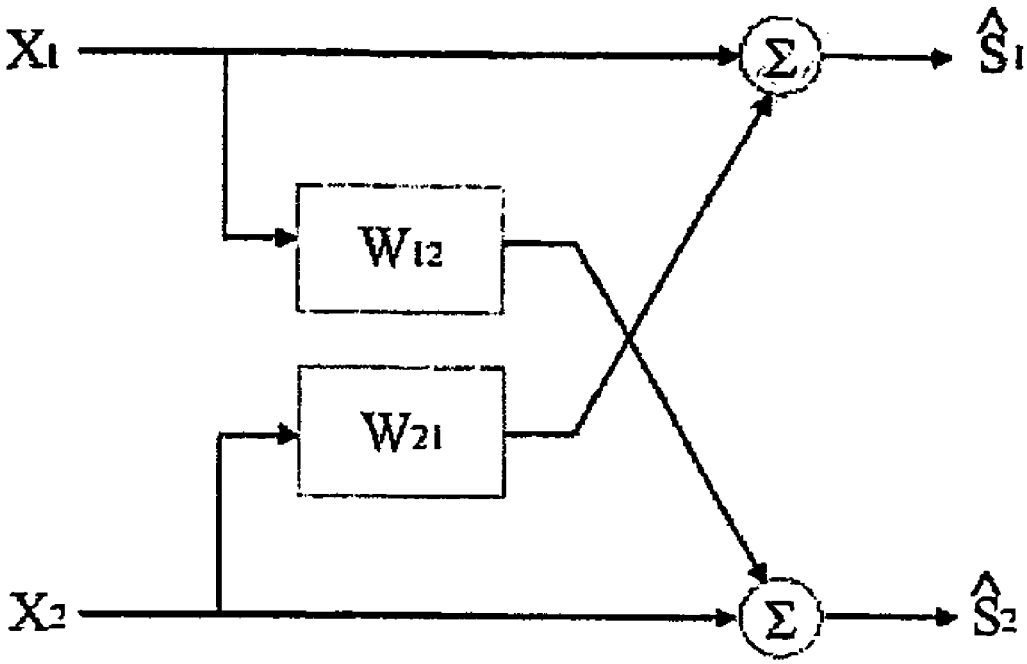
FIG. 4 is a De-mixing model.

The mixing model of FIG. 2 can be modified to be equivalent to the model of FIG. 3. The inversion of the transfer functions H12 and H21 allows recovering the original signals up to the modification induced by the transfer function G11 and G22. The de-mixing model is presented in FIG. 4.

The de-mixing transfer functions W12 and W21 can be estimated using higher order statistics or time delayed estimation of the cross-correlation between the two. The estimation of the model parameters can be either supervised (when only one source is active) or blind (when the speech and noise sources are active simultaneously). The learning rate of the model parameters can be adjusted according to the nature of the sound field condition in each frequency band. The resulting signals are the estimates of the clean speech and noise signals.

When the noise source is not in the direct sound field (reverberant environment) the mixing transfer functions become complicated and it is not possible to estimate them in real time on a typical processor of a hearing aid system. However, under the assumption that the speech source is in the direct sound field, the two channel of the binaural system always carry information about the spatial position of the speech source and it can be used to enhance the signal. A statistical based weighting approach can be used to extract the speech from the noise. The short-time coherence function allows estimating a probability of presence of speech. Such a measure defines a weighting function in the time-frequency domain. Applying it to the noisy speech signals allows the determination of the regions where speech is dominant and to attenuate regions where noise is dominant.

As it was presented previously, two enhancement approaches are used in the proposed approach. The aim of the sound field diffuseness detection is to detect the acoustical conditions wherein the hearing aid system is working. The detection block gives an indication about the diffuseness of the noise source. The result may be that the noise source is in the direct sound field, in the diffuse sound field or in-between. The information is given for each Bark or Mel frequency band. The coherence function presented previously estimates a measure of diffuseness. When the coherence is equal (or nearly equal) to one during speech pauses, the noise source is in the direct sound field. When it is close to zero, the noise source is in the diffuse sound field. For intermediate values, the acoustical environment is between direct and diffuse sound field.

Once the diffuseness of the sound field is known, the results of the parametric approach (source separation) and of the non-parametric approach (coherence) can be combined optimally to enhance the speech signals. The combination may be achieved gradually by weighing the signal provided by source separation through the diffuseness measure and the signal provided by the coherence by the complementary value of the diffuseness measure to one.

As the de-mixing transfer functions have been identified during the source separation, they can be used to reconstruct the spatiality of the sound sources. The noise source can be added to the enhanced speech signal, keeping its directivity but with reduced level. Such an approach offers the advantage that the intelligibility of the speech signal is increased (by the reduction of the noise level), but the information about noise sources is kept (this can be useful when the noise source is a danger). By keeping the spatial information, the comfort of use is also increased.

The invention claimed is:

1. Method for processing audio-signals whereby audio signals are captured at two spaced apart locations and subject to a transformation in perceptual domain, whereupon:

a. a source separation process is performed to give a first estimate of the wanted signal parts and the noise parts of the microphone signals and c. a coherence based envelope filtering is performed to give a second estimate of the wanted signal parts of the microphone signals, and where further a sound field diffuseness detection is performed on the at least two signals, whereby further the sound field diffuseness detections is used to mix the output from the blind source separation and the coherence based separation process in order to achieve the best possible signal.

2. Method as claimed in claim 1 whereby a virtual stereophonic reconstruction of the signal is performed prior to presenting the resulting audio signal to right and left ear of a person, where by the stereophonic recombination is performed on the basis of spatial information on the sound field.

3. Method as claimed in claims 1, where the sound field diffuseness detection is based on the value of a short-time coherence function where the coherence function is expressed as:

$$\Gamma_{x1x2}(k) = \frac{\phi_{x1x2}(k)}{\sqrt{\phi_{x1x1}(k) \cdot \phi_{x2x2}(k)}}$$

where k is the number of the frequency band in the Bark or Mel frequency space.

* * * * *